US005483995A

United States Patent [19]

Oertli

[11] Patent Number: 5,483,995

[45] Date of Patent: Jan. 16, 1996

[54] DEVICE FOR COUPLING AND UNCOUPLING LOOM HEALD SHAFTS

[75] Inventor: Gustav Oertli, Brütten, Switzerland

[73] Assignee: Sulzer Ruti AG, Winterthur, Switzerland

[21] Appl. No.: 324,051

[22] Filed: Oct. 14, 1994

[30] Foreign Application Priority Data

Nov. 24, 1993 [EP] European Pat. Off. ..... 93810816

[51] Int. Cl.[6] ..... D03C 9/00

[52] U.S. Cl. ..... 139/57

[58] Field of Search ..... 139/88, 57

[56] References Cited

U.S. PATENT DOCUMENTS

| | | | |
|---|---|---|---|
| 3,888,284 | 6/1975 | Tiernan . | |
| 4,365,653 | 12/1982 | Freisler et al. | 139/88 |
| 4,770,213 | 9/1988 | Peter | 139/88 |
| 5,050,644 | 9/1991 | Peter | 139/88 |

FOREIGN PATENT DOCUMENTS

| | | |
|---|---|---|
| 0242668 | 10/1987 | European Pat. Off. . |
| 0407335 | 1/1991 | European Pat. Off. . |
| 2466543 | 4/1981 | France . |
| 608040 | 12/1978 | Switzerland . |

*Primary Examiner*—Andy Falik

*Attorney, Agent, or Firm*—Townsend and Townsend and Crew

[57] ABSTRACT

A device for coupling and uncoupling heald shafts (1) to shaft rods (2) in a loom comprises first and second coupling portions (6, 7) attached to shafts (1) and shaft rods (2), respectively, and a latch member (8) for latching the coupling portions to each other. A pivotable actuating member (14) is pivotably coupled to the shaft drive to move the coupling portions between a rest position, where the shaft rods are uncoupled to the shafts, and a working position, where the shaft rods are coupled to the shafts for operation of the device. A support member (15) is coupled to the shaft drive and comprises a plurality of elongate holes (17) for receiving and guiding the shaft rods during operation of the loom and V-shaped notches (19) aligned with each of the elongate holes to secure the shaft rods in a stable position when the rods are uncoupled to the shafts. The shaft rods are designed so that the ratio of the length of each rod to the maximum stroke height, i.e., the axial distance in which the shaft drive reciprocates the shaft rods, creates a free space underneath the shafts for permanently guiding the shaft rods into the support member.

7 Claims, 4 Drawing Sheets

DEVICE FOR COUPLING AND UNCOUPLING LOOM HEALD SHAFTS

BACKGROUND OF THE INVENTION

The invention is directed to a device for coupling and uncoupling shafts, such as heald shafts, to shaft rods in a loom. Typically, these devices will comprise first and second coupling portions attached to the shafts and shaft rods, respectively, and a latch member for latching the coupling portions to each other. A pivotable actuating member is pivotably coupled to the shaft drive to move the coupling portions between a rest position, where the shaft rods are uncoupled to the shafts, and a working position, where the shaft rods are coupled to the shafts for operation of the device.

SUMMARY OF THE INVENTION

The object of the invention is to provide a device for coupling and uncoupling shafts to or from a shaft drive having a plurality of shafts, wherein the device aligns and holds the coupling parts in a stable position during coupling and uncoupling and permanently guides the shafts during the movement and at rest.

The advantage which can be achieved with the invention is that the device takes account of the space limitation beneath the shafts.

The shaft rod, which takes account of the ratio of the free rod length $L_{St}$ to the maximum stroke height $Hub_{max}$, creates a free space beneath the shafts in order to permanently guide the shaft rods into a receiving part. The following advantages ensue from this: the shaft rods are held in position when the shafts are absent, they are guided during the occasional lubrication stroke, a reduction of the stroke of the unnecessary shaft drives is not required and the shaft change, for example, during the change of the article, is made easier because the shaft rods retain their position.

It is advantageous in the loom if the shaft drive member and the shed are associated with one another in such a manner that the ratio of the distance $H_{tot}$, measured from the articulation point of the shaft rod to the lower edge of the shaft, to the maximum stroke height $Hub_{max}$, measured in the direction of shaft movement amounts to 2.4 at the most. It is an advantage that the receiving part and the actuating member of the device for coupling and uncoupling shafts can remain in the same axial position beneath the shafts in relation to the operational and rest positions without changing the operational height, i.e., of the level of the fell of the cloth. It is thus possible not only to retain the known, advantageous dimensions of the loom in new looms but in the same way to retrofit existing looms, with appropriate devices for coupling and uncoupling shafts.

BRIEF DESCRIPTION OF THE DRAWINGS

The invention is explained by means of example only and with reference to the enclosed figures which show:

FIGS. 1 and 2 show a preferred embodiment of the device for coupling and uncoupling a heald shaft 1 to or from a shaft rod 2. The shaft rod has a bar 3, a coupler 4 which is connected in an articulated manner with a drive member 5 of a shaft drive (not illustrated), and a coupling part 6 which can be brought into and out of engagement with a coupling part 7 on the shaft 1. The coupling part 6 of the shaft rod 2 has two latch members 8 which can be brought into and out of operative connection with the coupling part 7 on the shaft 1. One latch member 8 is provided with a striking bar 9 for this purpose.

Figure 1:
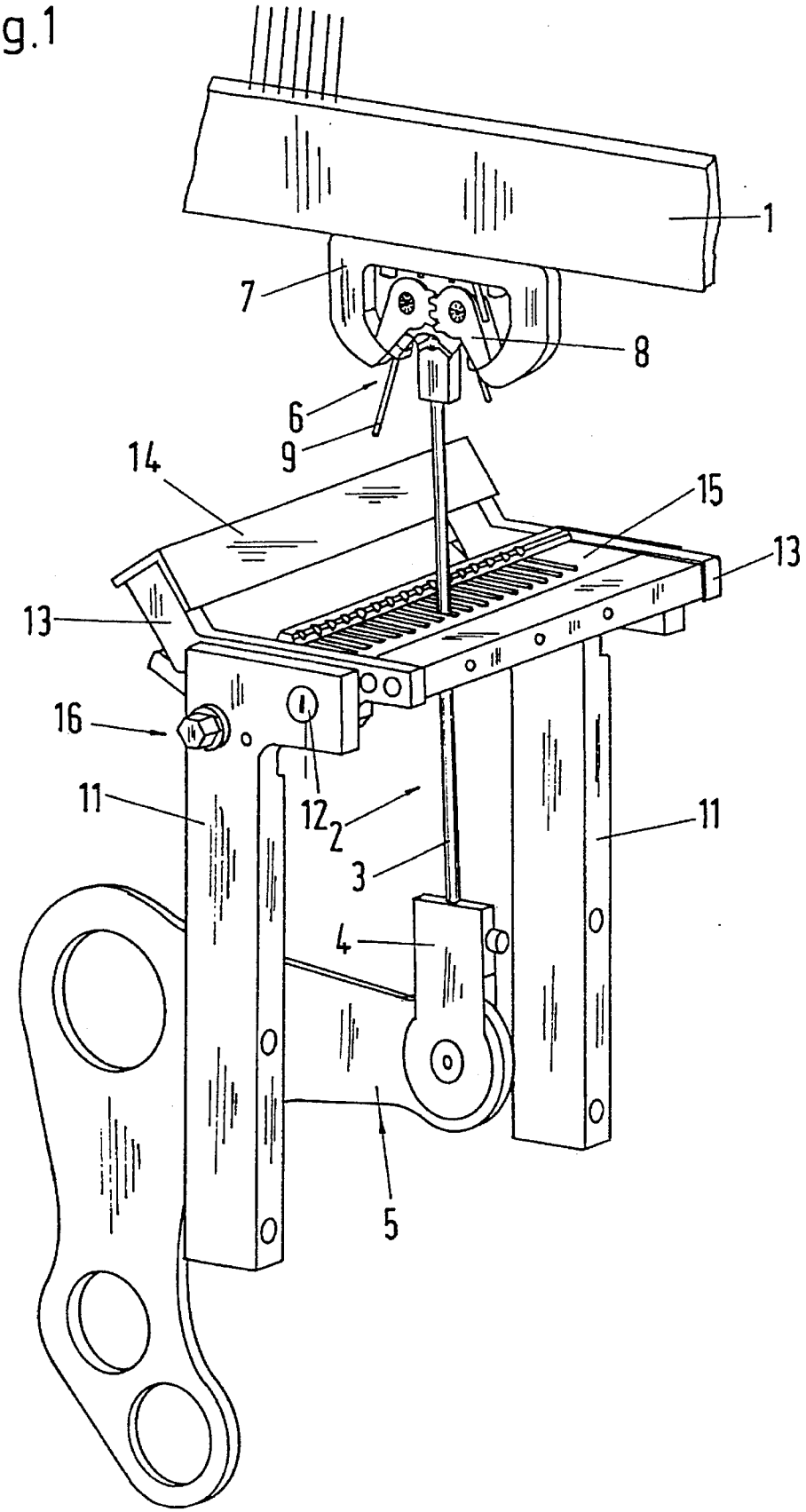
FIG. 1 is a spatial representation of one embodiment of an actuating means according to the invention in the rest position.
Figure 2:
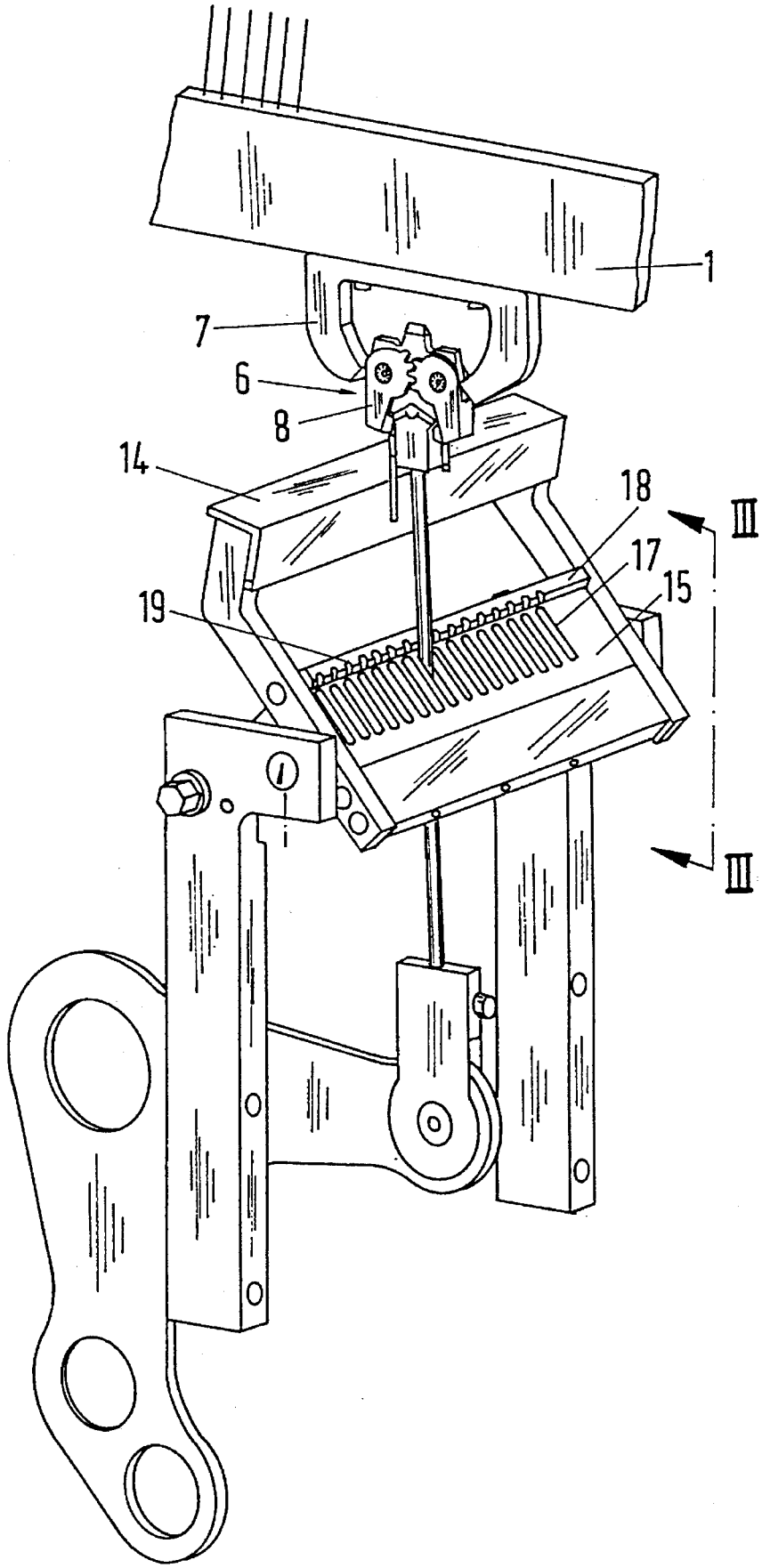
FIG. 2 is a side elevation of the actuating means of FIG. 1 in the working position.

The device comprises two holders 11 which are mounted on a frame (not shown), an axle 12 which is secured in the holders 11, two carrying members 13 which are pivotably arranged on the axle 12, an actuating member 14 for the latch members 8 of the coupling parts 6, a receiving part 15 for the shaft rods 2, which are secured on the two carrying members 13, and a setting means 16 which is in operative connection with the carrying members 13 in order to set the actuating member and the receiving part from a rest position (FIG. 1) into a working position (FIG. 2).

The receiving part 15 has a number of elongate holes 17 (FIG. 2) which are arranged parallel to one another, the number of the elongate holes 17 corresponding to the possible number of shafts 1 of a shaft set. The actuating member 14 is a continuous part, the length of which is determined by the possible number of shafts 1, in order to simultaneously actuate all the coupling parts 6 on the shaft drive side.

The receiving part 15 has two projections 18 which are disposed bordering on the elongate holes 17. The projections 18 project from the upper and lower sides of the receiving part, respectively, and are provided with V-shaped notches 19 which are aligned with respective elongate holes 17 (FIG. 3).

Figure 4B:
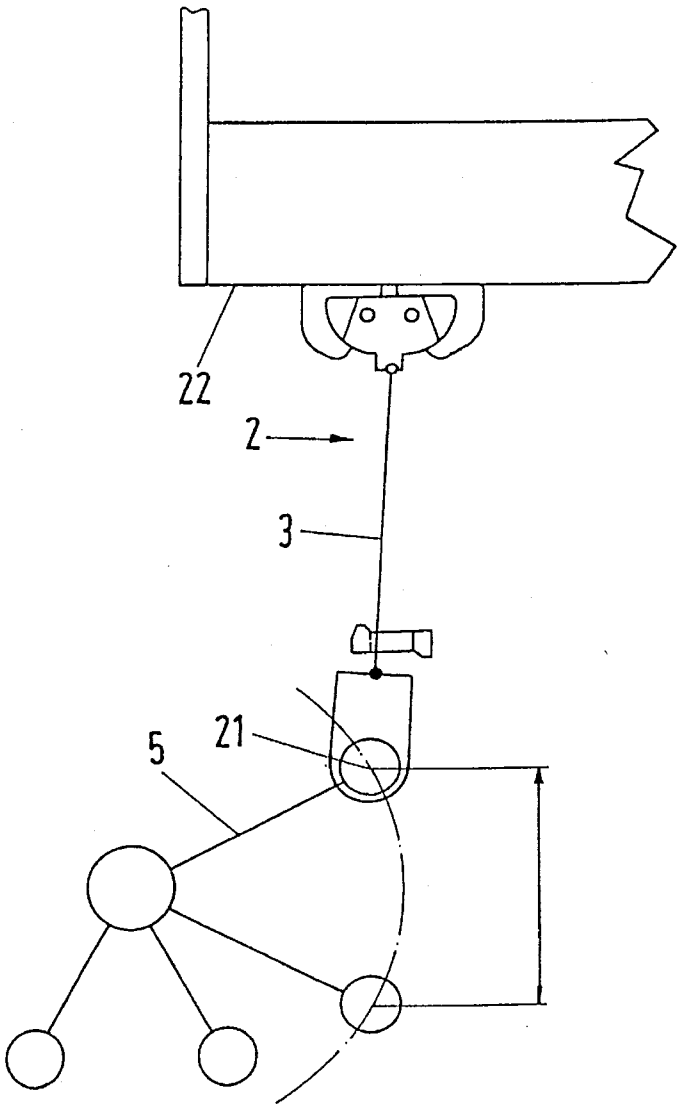
FIG. 4*a* is a schematically represented part of the shaft drive in the lower shed position and FIG. 4*b* illustrates the shaft drive of FIG. 4*a* in the upper shed position.
Figure 4A:
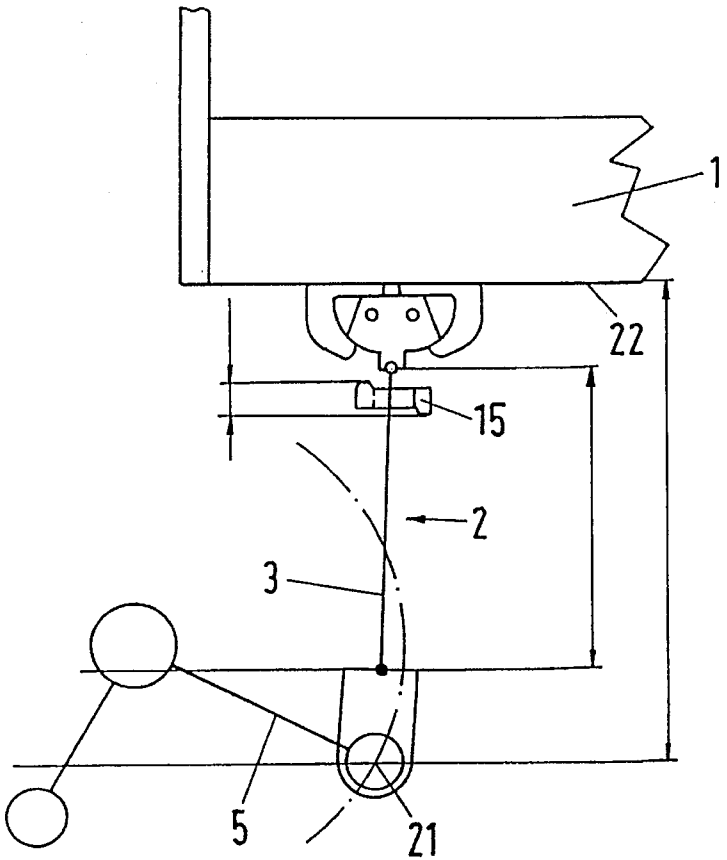

As shown in FIGS. 4*a* and 4*b* in particular, the device is arranged beneath the shafts 1 in a loom (not illustrated). The device is mounted in the loom by means of the holders 11 so that the receiving part 15 is arranged on a level in such a manner that during the movement the receiving part 15 guides the shaft rods 2 substantially over the free length of the bar 3. For this purpose, the shaft rod 2 is formed such that the ratio of the free bar length $L_{St}$ to the maximum stroke height $Hub_{max}$ amounts to at least 1.1 as measured in the direction of motion of the shaft 1. Furthermore, the shaft drive member 5 and the shed 1 are associated with one another in the loom in such a manner that the ratio of the distance $H_{tot}$, measured from the articulation point 21 of the shaft rod 2 to the lower edge 22 of the shaft 1, to the maximum stroke height $Hub_{max}$, measured in the direction of motion of the shaft, is at most 2.4. By means of this association, a free space is created in accordance with the invention beneath the shafts 1 in which the receiving part 15 is arranged, so that a permanent guiding of the shaft rods 2 during the movement is achieved in an advantageous manner. This also applies to the non-coupled shaft rods regardless of whether these rods are actuated by the shaft drive or are standing still.

In the illustration of FIG. 2, the device is in the working position. In this position, the actuating member 14 has pivoted the latch members so that the coupling parts 6, 7 are uncoupled and the receiving part 15 holds the shaft rods 2 in stable positions so that the shaft 1 can be either lifted off or inserted. During insertion of the shaft 1, the shaft-side coupling part 7 is pushed over the shaft-drive-side coupling part 6, with the coupling parts being aligned with one another and connected in a form-locked manner.

Figure 3:
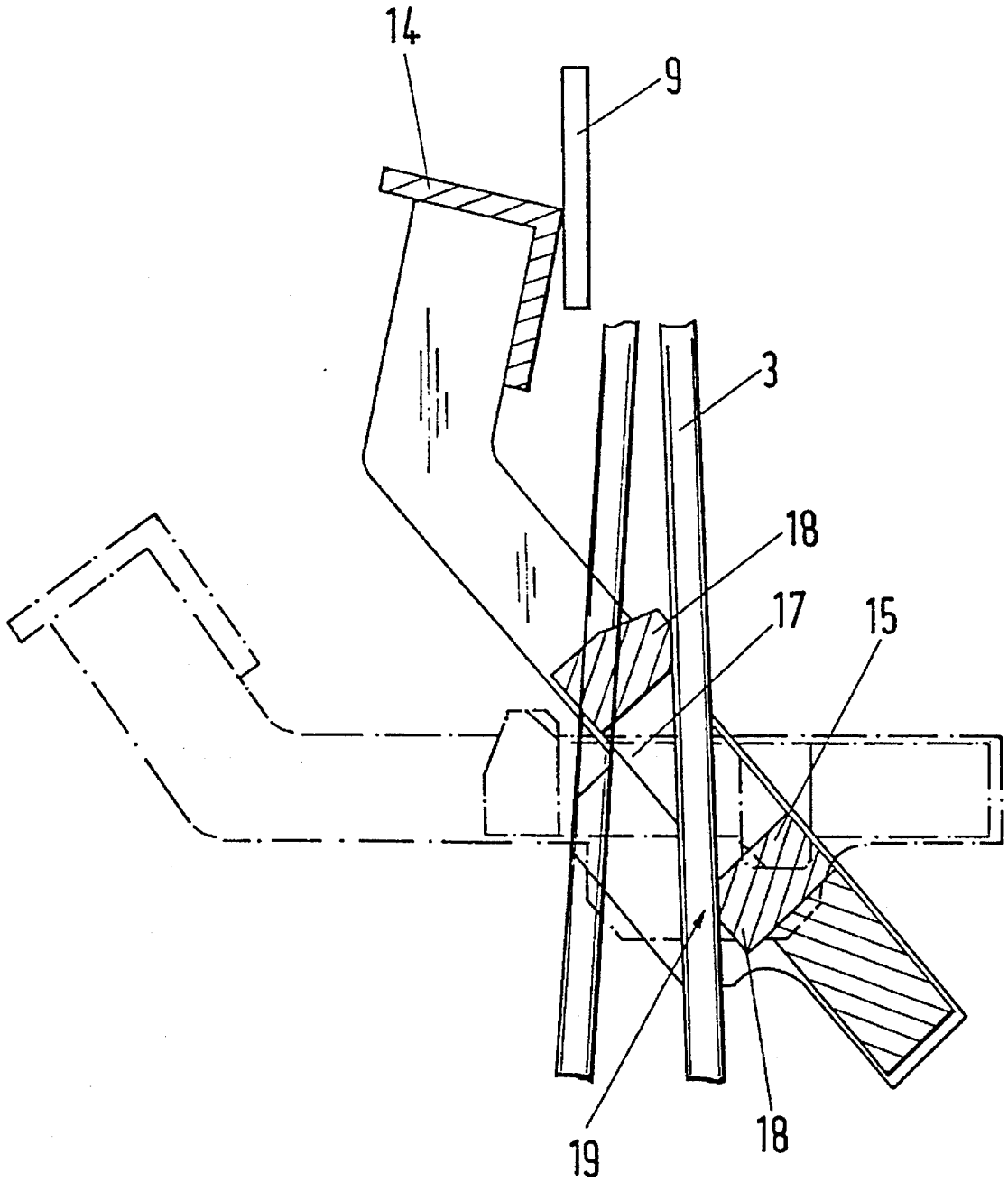
FIG. 3 is a sectional view taken along the line III—III in FIG. 2.

As FIG. 3 shows, the shaft rod 3 is arranged in the V-shaped notches 19 when the device adopts the working position so that the shaft rods are aligned and held in a stable position. When the device adopts the rest position, the shaft rods 2 are guided in the elongate holes 17, as is illustrated by the dot-dash lines in FIG. 3.

The device comprises an actuating member for the shaft lock and a receiving part 15 which, in the rest position of the device, guides the shaft rods 2 and, in the working position, locks the shaft rods and consequently the shaft locks, in order to insert the shafts.

The device is arranged in a loom beneath the shafts 1, so that the receiving part 15 lies on a level and permanently guides the shaft rods 2. The free space necessary for this is created by the design of the shaft rods 2 taking account of the ratio of free bar length $L_{St}$ to maximum stroke height $Hub_{max}$.

I claim:

1. A device for coupling and uncoupling a plurality of heald shafts to a plurality of shaft rods in a shaft drive comprising:

a first coupling element attached to each shaft;

a second coupling element attached to each shaft rod;

a latching member for latching each of the first coupling elements to respective second coupling elements;

an actuating member coupled to the shaft drive for moving the shaft rods between a working position, where the shaft rods are coupled to the shafts, and a rest position, where the shaft rods are uncoupled from the shafts; and a support member coupled to the actuating member, the support member having guide elements for receiving and guiding the shaft rods during operation of the shaft drive and holding elements for securing the shaft rods in a stable position when the shaft rods are in the rest position uncoupled from the shafts.

2. The device of claim 1 wherein the guide elements of the support member include a plurality of elongate holes formed in the support member, the shaft rods each being slidably disposed within one of the elongate holes.

3. A device for coupling and uncoupling a plurality of heald shafts to a plurality of shaft rods in a shaft drive comprising:

a first coupling element attached to each shaft;

a second coupling element attached to each shaft rod;

a latching member for latching each of the first coupling elements to the respective second coupling elements;

a pivotable actuating member coupled to the shaft drive for moving the shaft rods between a working position, where the shaft rods are coupled to the shafts, and a rest position, where the shaft rods are uncoupled from the shafts; and a support member coupled to the actuating member, the support member having guide elements for guiding the shaft rods during operation of the shaft drive, the guide elements defining V-shaped notches for securing the shaft rods in a stable position when the shaft rods are in the rest position uncoupled from the shafts.

4. A loom comprising:

a plurality of heald shafts each having a lower surface;

a shaft drive having a plurality of drive members and a plurality of shaft rods movably coupled to the drive members at pivots, the pivots being a first distance from the lower surface of the shafts, the shaft drive being adapted to reciprocate the shaft rods a second distance in an axial direction; and a device for coupling and uncoupling the shafts to the shaft rods comprising:

a first coupling element attached to each shaft;

a second coupling element attached to each shaft rod;

a latching member for latching each of the first coupling elements to the respective second coupling elements;

a pivotable actuating member coupled to the shaft drive for moving the shaft rods between a working position, where the shaft rods are coupled to the shafts, and a rest position, where the shaft rods are uncoupled from the shafts; and a support member coupled to the actuating member, the support member having guide elements for guiding the shaft rods during operation of the shaft drive and holding elements for securing the shaft rods in a stable position when the shaft rods are in the rest position uncoupled from the shafts, wherein a ratio of the first distance to the second distance is less than or equal to 2.4.

5. The loom of claim 4 wherein the shaft rods each have an axial length, wherein a ratio of the axial length of the shaft rods to the second distance is greater than or equal to 1.1.

6. The loom of claim 5 wherein the support member is fixed with respect to the shaft rods, the support member being positioned such that each guide element contacts essentially the entire axial length of one of the shaft rods when the respective shaft rod is reciprocated over the second distance by the shaft drive.

7. A loom comprising:

a plurality of heald shafts;

a shaft drive comprising a plurality of drive members and a plurality of shaft rods movably coupled to the drive members; and a device for coupling and uncoupling the shafts to the shaft rods comprising:

a first coupling element attached to each shaft;

a second coupling element attached to each shaft rod; and means for attaching and detaching the coupling elements to and from each other; and a support member coupled to the shaft drive, the support member having guide elements for guiding the shaft rods during operation of the shaft drive and holding elements for securing the shaft rods in a stable position when the shaft rods are detached from the shafts.

* * * * *